United States Patent [19]

McCann

[11] Patent Number: 5,042,346

[45] Date of Patent: Aug. 27, 1991

[54] APPARATUS FOR FABRICATING ACCURATE MITERED CORNERS

[75] Inventor: James M. McCann, Trotwood, Ohio

[73] Assignee: Shopsmith, Inc., Dayton, Ohio

[21] Appl. No.: 448,444

[22] Filed: Dec. 11, 1989

[51] Int. Cl.[5] ..... B26D 7/06; B26D 5/02

[52] U.S. Cl. ..... 83/421; 83/437/468.3; 144/216

[58] Field of Search ..... 83/437, 468.3, 474, 83/477.2, 421, 435.1; 33/474; 144/216, 217

[56] References Cited

U.S. PATENT DOCUMENTS

| | | | |
|---|---|---|---|
| 790,182 | 5/1905 | Butterworth | 83/437 X |
| 2,857,943 | 10/1958 | McEwan et al. | 83/437 X |
| 2,968,325 | 1/1961 | Wanovik | 83/437 |
| 3,083,744 | 4/1963 | Vold | 83/437 X |
| 4,158,320 | 6/1979 | Kay | 83/437 X |
| 4,165,668 | 8/1979 | McCord, Jr. | 83/437 X |
| 4,646,801 | 3/1987 | Hines | 83/477.1 X |
| 4,741,387 | 5/1988 | Strong | 83/437 X |

*Primary Examiner*—Steven C. Bishop

*Attorney, Agent, or Firm*—Biebel & French

[57] ABSTRACT

A fixture to be used in cutting 45° mitered ends on wooden workpieces by means of a table saw having an adjustable miter gauge movable on the worktable past either side of the saw blade has in plan the outline of an isosceles right triangle. This fixture is mounted on the miter gauge with its base face engaging the normal working face of the miter gauge. With the miter gauge adjusted with its working face at approximately 90° to the saw blade, when the gauge moved along one of the guide tracks in the worktable and then along the other guide track without changing its adjustment, the angles respectively defined by the saw blade and the adjacent face on the fixture will total 90° irrespective of any deviation of the adjustment of the miter gauge from an accurately perpendicular relation with the saw blade. Thus with each of four workpieces having one end cut off on one side of the saw blade and the other end cut off on the other side of the saw blade, when the four workpieces are assembled to define a rectangular shape, each corner thereof will be an accurately right angled corner. In another embodiment, which is used independently of a miter gauge, the fixture has a slide bar fixed to its under surface in parallel relation with its hypotenuse side, the slide bar guides the fixture along a guide groove in the saw table, and each workpiece has one end miter cut while held against one working face of the fixture, and the other end miter cut while held against the other working face.

9 Claims, 9 Drawing Sheets

APPARATUS FOR FABRICATING ACCURATE MITERED CORNERS

BACKGROUND OF THE INVENTION

The fabrication of mitered joints on wooden workpieces is a very common problem, and especially the cutting of 45° mitered ends to form rectangular structures such as frames for paintings and other pictures, door and window frames, doors, windows and screens, and many other similar end products. It is still, however, a continuing problem, especially for the home workshop operator, to obtain truly accurate 45° cuts on all of the eight workpiece ends which are needed to make a truly rectangular frame or other mitered cornered product.

Probably the most common cause contributing to unsatisfactory mitered joints is that if the saw blade and whatever guide or jig is used therewith do not assure that each cut on each end of each workpiece is accurately at 45° to the length of the workpiece and perpendicular to its surfaces, whatever deviation in accuracy exists will affect each corner of the end product. In other words, the total effect of even very small error will be multiplied by a factor of eight for the end product when each cut is made with the workpiece on the same side of the saw blade.

More specifically, if it is assumed that the saw blade is accurately perpendicular to the associated worktable but that the actual cut is at 45.2° to the length of each workpiece, and that each cut is made with the blade in the same position, then when it is attempted to join the four workpiece to form a rectangular frame, the error at any one corner will be 0.4°, the total error at the first three corners will be 1.2°, and the fourth corner cannot be completed without warping the frame. This condition is bad enough when the saw blade is accurately perpendicular to the worktable, but it becomes worse when the saw is tilted, whether or not it is set to cut at an accurate 45° to the length of each workpiece.

It is theoretically possible to compensate for such irregularities by making each mating pair of mitered cuts on opposite sides of the saw blade, in which case whatever deviation there may be from the desired accurate cut is compensated for by deviation in the opposite direction of the mating cut on the other workpiece. To carry out this operation, however, is not as simple as it sounds.

In the first place, there are four commonly available ways of making a controlled angular cut on a wooden workpiece. The first is to use a miter box which includes adjustable guides for supporting a hand saw, but this adds a number of difficulties. One is that the saw must neccessarily have a running clearance in the guides, which inherently affects the accuracy of the cut, in both horizontal and vertical planes. For example, the blade may tilt in one or both planes, any such deviation is established as soon as the teeth have firm engagement with the workpiece, and there is no practical way of compensating for the resulting error.

A miter box also requires that the saw guides be set to define the desired angle between the saw blade and the fence against which the workpiece is held during the sawing operation. Even with built-in stops, this angle can readily deviate from a true 45°. This particular type of deviation can be compensated for by cutting the opposite ends of each workpiece on opposite sides of the saw blade provided the workpieces are turned over between cuts. However, this can be done only with workpiece having top and bottom surfaces which are flat and parallel with each other, and it cannot be successfully done with wood having a profiled surface on one side. Otherwise, the saw guides must be moved to their other 45° position, which can also vary in either direction from an accurate 45° setting.

Mitering saw assemblies wherein a power-operated saw is supported on a base for vertical movement offer little improvement over hand-operated miter boxes as discussed above. In such units, the work-supporting table and fence must be adjustable rotationally with respect to the saw blade to establish the angle of cut with respect to the fence. As with the conventional miter box, however, there is no assurance that either of the two 45° positions will be accurate, and the same limitations exist with respect to mating cuts on opposite sides of the saw blade.

Another alternative is a radial arm saw, wherein the power-operated saw blade travels on a horizontal arm above the worktable, and this arm is adjustable to vary the angle between the direction of cut and the fence at the back of the worktable. This type of saw offers all of the same disadvantages and opportunities for error as a powered miter box as discussed above.

The remaining one of the commonly available saw types is a table saw wherein the power operated saw is mounted below the table with its blade projecting upwardly through a slot so that the workpiece can be moved along the table with respect to the blade. Such a saw is usually provided with a miter gauge which is movable along a guide track located on opposite one or both sides of the blade, and which is adjustable to establish the angle defined by the blade and the working face on the gauge against which each workpiece is held as it is moved past the blade.

This type of table saw arrangement still offers the same disadvantages and opportunities for error as the other types of mitering apparatus discussed above. In particular, in order to make miter cuts on profiled workpieces, the adjustment of the miter gauge must be changed, regardless of whether all cuts are made on the same side of the blade or they made alternately on opposite sides of the blade. Any change of adjustment is inherently capable of resulting in error, for the reason already discussed, and there is therefore no greater assurance that the mating cuts will be accurate when they are made on a table saw as when they are made on any of the alternative mitering saw assemblies.

SUMMARY OF THE INVENTION

In accordance with one embodiment of the present invention, there is provided a fixture for use with a table saw equipped with a miter gauge which will assure that the miter cuts on the two ends of a workpiece will from accurate right angles with similarly cut workpieces even though each of the original cuts may deviate from an accurate 45° angle to the length of the workpiece and/or from an accurate perpendicular relation to the face of the workpiece.

More specifically, it is a primary object of the invention to promote the assured fabrication of accurate right angled corners between the four sides of an open square or otherwise rectangular frame or other product even though the face of each individually cut end may deviate from an accurate 45° relation the end of the piece, and/or the face of the cut end may deviate from a truly perpendicular relation with the top and bottom surfaces of the piece.

The present invention is directly concerned with the fabrication of right angled corners between wooden workpieces which are prepared by having their ends miter cut on a table saw assembly which includes a workpiece provided with an adjustable miter gauge movable past the saw blade along either of a pair of guide tracks located respectively on opposite sides of the saw blade, and specifically on such a table saw assembly wherein the miter gauge is adjustable in accordance with the angle desired to be defined by the saw blade and the working face of the miter gauge against which a workpiece held as it is moved past the blade.

The invention provides a fixture which is designed to be secured to the miter gauge face in such a saw assembly, and which includes a pair of working faces arranged at an angle of exactly 90° to each other. With this fixture in place, and with the miter gauge adjusted with its working face at approximately 90° to the saw blade, when the gauge is moved along one of the guide tracks in the worktable and then along the other without changing its adjustable mounting, the angles respectively defined by the saw blade and the adjacent working face on the fixture will total 90° irrespective of any deviation of the setting of the miter gauge from an accurately perpendicular relation with the saw blade.

In accordance with another embodiment of the invention, which is designed for use with a table saw but does not require an adjustable miter gauge, the same fixture described above may be provided on its under surface with a slide bar configured for accurately guided linear movement in a groove which forms a guide track along the worktable parallel with the slot through which the saw blade projects. In this embodiment, each of the two working faces of the fixture converge toward the saw blade, and each defines an angle of approximately 45° with the saw blade, and they are machined at exactly 90° to each other.

In the use of this embodiment, the preferred practice is to miter cut one end of each workpiece by holding the outside face each successive piece against the trailing working face of the fixture as the fixture and workpiece are moved past the saw blade. The other end of each workpiece is then miter cut by holding the same face of the workpiece as before agaist the leading face of the fixture as the fixture is moved past the saw blade along the same guide track. The length of each miter cut workpiece is accurately established by an adjustable stop of unique characteristic mounted on an extension of the leading face of the fixture.

Other features and advantages of the invention, and the specific structure by which they are provided, will be apparent from or pointed out in connection with the detailed description of a preferred embodiment of the invention which follows.

DESCRIPTION OF THE PREFERRED EMBODIMENT

Figure 1:
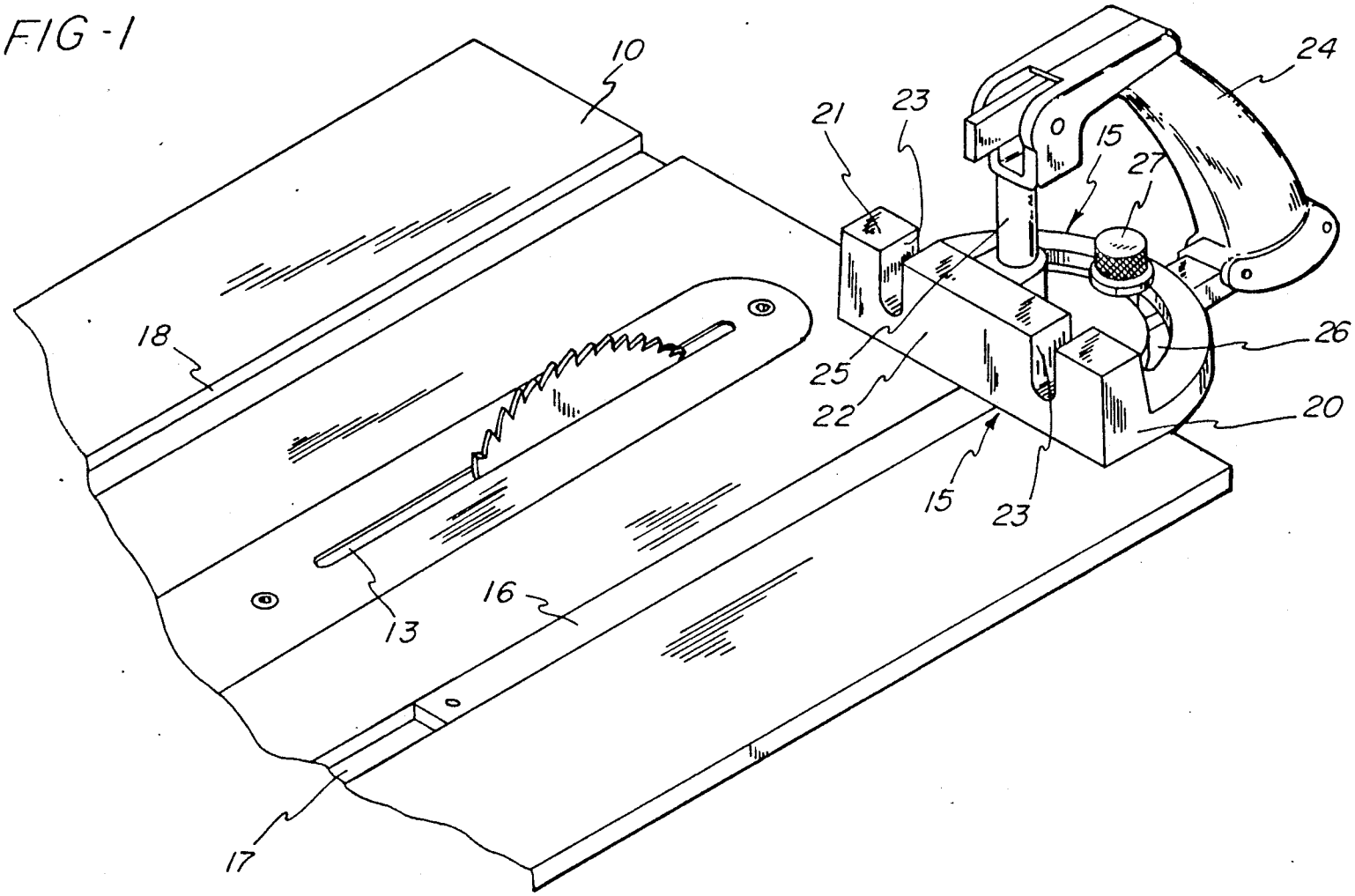
FIG. 1 is a perspective view illustrating the relevant portion of the table saw set-up of a multi-purpose tool with which the fixture of the invention is designed to be used to produce a 45° miter cut on a wooden workpiece, but with the saw guard removed for purposes of clarity.

FIG. 1 illustrates somewhat fragmentarily the table saw set-up of a multi-purpose tool generally of the construction shown in co-owned Bartlett et al U.S. Pat. No. 4,566,510. It includes a worktable 10 and a poweroperated circular saw blade 11, which is mounted below the worktable and projects upwardly through a longitudinal slot 13 in the worktable. A miter gauge 15, which may be of essentially the construction shown in Goldschmidt U.S. Pat. No. 2,759,503, includes a guiding bar 16 configured for sliding movement in each of the pair of grooves 17 and 18 which form guide tracks located on opposite sides of the slot 13 and parallel therewith and to the saw blade 11.

Figure 7:
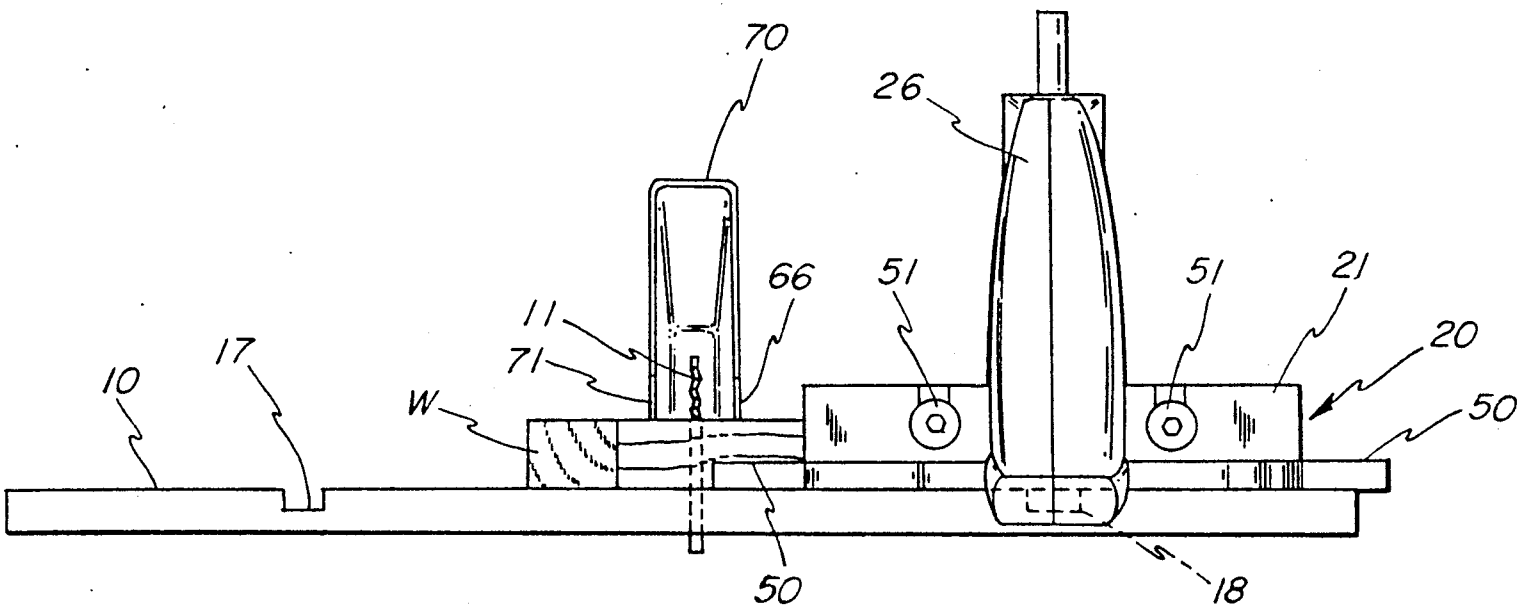
FIG. 7 is an elevational view from the infeed side of the saw illustrating the use of the fixture of the invention in cooperation with a saw guard but with the normal blade height increased as in FIG. 6.

An upper saw guard would be mounted on the table, as seen in FIG. 7, but it has been removed in FIG. 1 so that the relationships between the saw blade, table and miter gauge can seen. In all actual sawing operations, both upper and lower guards will always be in place, and the blade protrusion through the stock is limited to no more than ¼ inch.

The protractor head 20 of the miter gauge 15 includes a front section 21 having a flat vertical guide face 22 and an open slot 23 adjacent each end of the top thereof. A manual handle 24 is mounted on the gauge protractor head 20 by a vertical stud 25, and the head 20 is mounted for pivotal movement on the bar 16 about a vertical axis which is preferably coaxial with the stud 25. The protractor head 20 also includes a curved rear portion having an arcuate slot 26 therethrough which is centered on the pivotal axis of head 20 on bar 16. A clamping knob 27 is threaded on a stud projecting through the slot 26 from the bar 16, to clamp the gauge protractor head 20 in any desired angular relationship of its vertical face 22 with the length of the bar 16. The total extent of this angular adjustment is preferably 60° in either direction from the position wherein the face 22 is perpendicular to the length of bar 16. An accurate pointer is provided to indicate the angular setting of the miter gauge.

In the normal use of the saw assembly shown in FIG. 1, the miter gauge 15 is manually adjusted to the position wherein the vertical face 22 defines with the saw blade 11 a desired angle establishing the line of cut across a workpiece. Thus if a cross-cut is desired, the miter gauge 15 is adjusted to position the face 22 at right angles to the length of the bar 16 as shown in FIG. 1, and the cut is made by holding the workpiece against the face 22 and using the miter gauge to push the workpiece past the saw blade.

The procedure is similar for any cut defining an angle of other than 90° with the length of the workpiece. Thus in making mitered corners, the miter gauge 15 is adjusted to the position wherein the face 22 defines an angle of 45° with the length of the bar 16, and the same cutting procedure is followed. Necessarily, however, the actual angle defined by the cut and the length of the workpiece depends upon the accuracy with which the operator adjusted and secured the protractor head 20 on the bar 16.

As noted above, deviation from absolute accuracy can be compensated for, when the workpieces have flat top and bottom surfaces, by turning each workpiece over for the second cut thereon. If, however, the workpiece stock has a profiled surface, this procedure is not a practical possibility, because the profiled surface will cause the workpiece to tilt on the worktable and thus causes a cut which will not mate properly with the cut made with the profiled surface uppermost.

For profiled workpiece to be miter cut with a miter gauge 15, either of two procedures can be followed, but both require resetting of the miter gauge. One procedure is first to set the miter gauge with the face 22 defining an angle of 45° with the right edge of the bar 16, to cut one end of each workpiece with that setting of the miter gauge, and then to cut the other end of each workpiece after readjusting the miter gauge to the position wherein the face 22 defines an angle of 135° with the right edge of the bar 16. The alternative procedure would be to shift the miter gauge to the other side of the saw blade after miter cutting one end of each workpiece, and then to readjust the gauge to the position wherein the face 22 defines an angle of 45° in the opposite direction with the length of the bar 16 before the other end of each workpiece is cut.

Neither of these procedures provides assurance of accurate miter cuts, because the accuracy of the mating cuts would be directly dependant upon the degree of accuracy of each setting of the miter gauge. Also, the first procedure is not recommended for the additional reason that it results in a tendency of the saw blade to jam against the workpiece. The second procedure would be preferable, to the extent that it would at least partially compensate for any decree of tilting of the saw blade with respect to the surface of the worktable, but even that degree of correction would be affected by the accuracy of the angle setting of the miter gauge itself.

Figure 6:
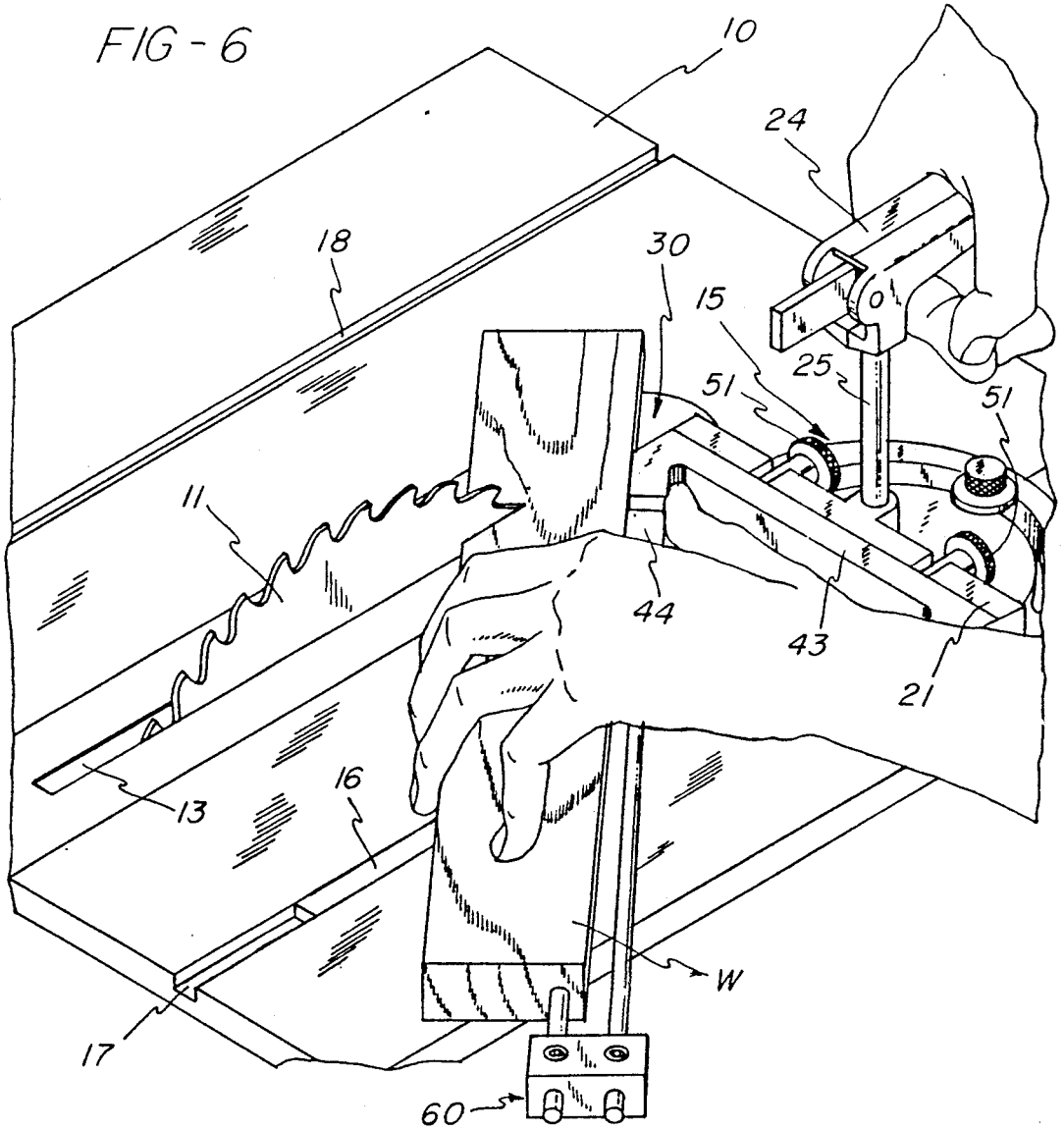
FIG. 6 is a fragmentary perspective view illustrating the use of the fixture of the invention in cutting the first mitered corner on a workpiece, and with a stop rod installed to locate the workpiece accurately with respect to the saw blade, again, with the saw removed and normal blade height increased for purposes of clarity.

The present invention provides for effective correction of either or both types of deviation, by means of the fixture 30, which is shown in use in FIGS. 6 and 7. Fixture 30, as best in FIGS. 2–5, has in plan the configuration of an isosceles right triangle providing a vertical hypotenuse face 33 and the pair of vertical working faces 34 and 35 converging from the hypotenuse face 33 at angles of 45° thereto so that the faces 34 and 35 define an angle of 90°. More specifically, the fixture 30 consists of a body 40 which may be readily cast from a suitable material such as aluminum, and in the interest of reduced weight, it may be essentially hollow except for a web 41 and other supporting webs which interconnect its three outer walls 43, 44 and 45.

Figure 2:
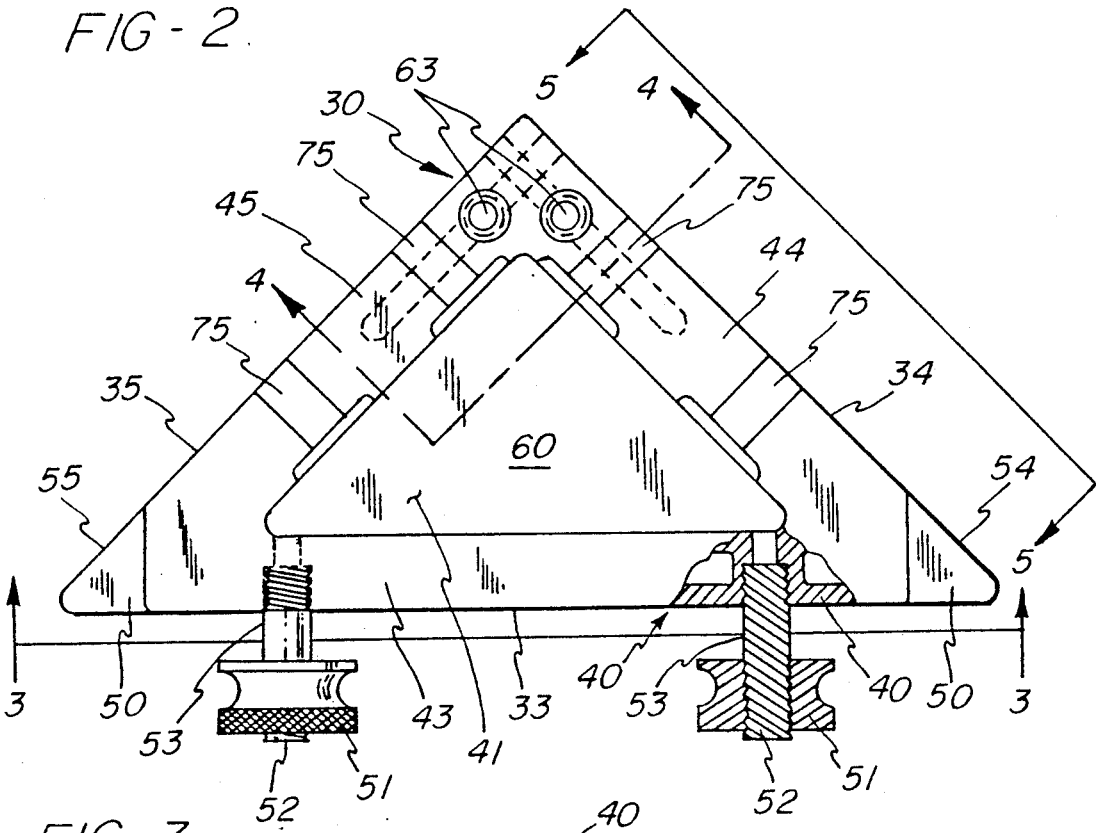
FIG. 2 is a top view, partly broken away, of a fixture embodying the invention.
Figure 3:
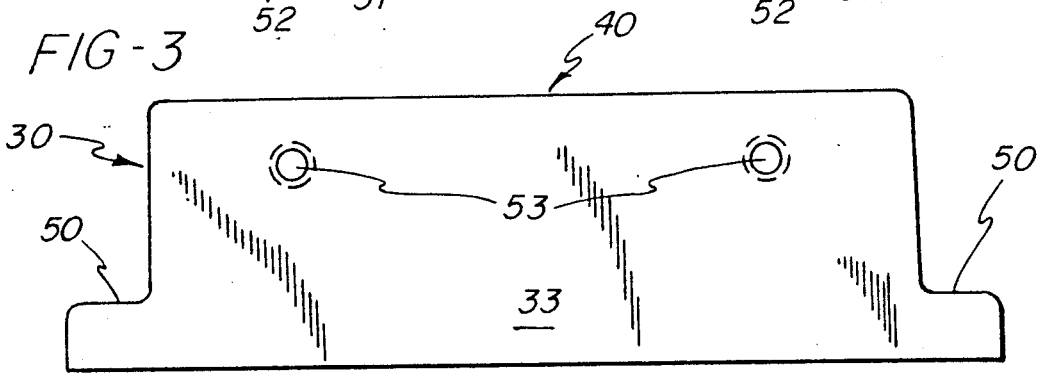
FIG. 3 is an elevational view of the same fixture looking as indicated by the line 3—3 in FIG. 2.
Figure 4:
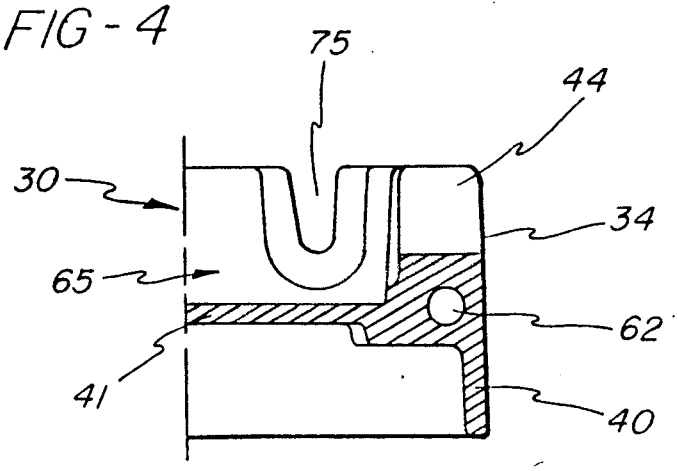
FIG. 4 is a fragmentary section on the line 4—4 in FIG. 2.
Figure 5:
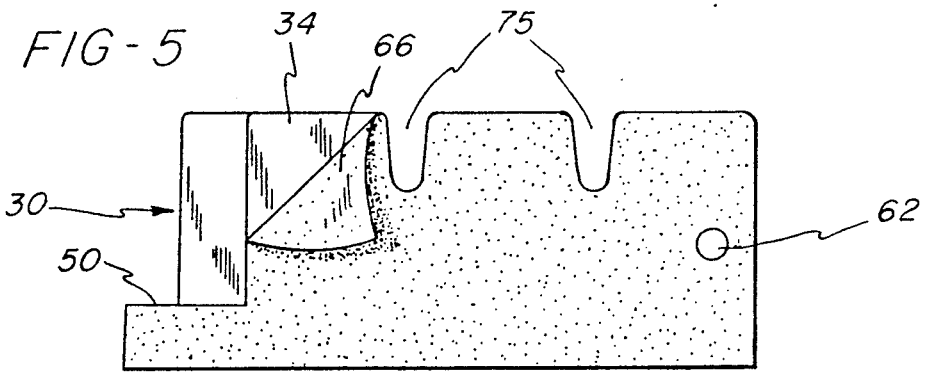
FIG. 5 is an elevational view looking in the direction indicated by the line 5—5 in FIG. 2.

The vertical dimension of the body 40 is preferably such that the height of each of its three faces 33, 34 and 35 is approximately equal to the height of the miter gauge face 22, e.g. 2 inches. As best seen in FIGS. 2 and 3, the upper portion of the body 40 is truncated at both ends of the wall 43 to provide a pair of shoulders 50 having a substantially smaller vertical dimension than the remainder of the wall 43, e.g. ½ inch. The remainder of the wall 43 and its face 33 should be at least as long as the miter gauge face 22, e.g. 5 to 6 inches.

The fixture 30 is used by mounting it on the miter gauge 15 with its hypotenuse face 33 engaging the miter gauge face 22. The two are secured together by a pair of clamp knobs 51 (FIGS. 2, 6 and 7) threaded on stud 52 which are permanently mounted in threaded bores 53 in the wall 43 and extend therefrom through the slots 23 (FIG. 1) at the top of the miter gauge face 22. With the parts proportioned as described, therefore, the shoulders 50 project beyond the ends of the miter gauge face 22, for reasons explained hereinafter, but each includes a face 54, 55 which forms a continuation of the adjacent face 34 or 35.

Figure 10:
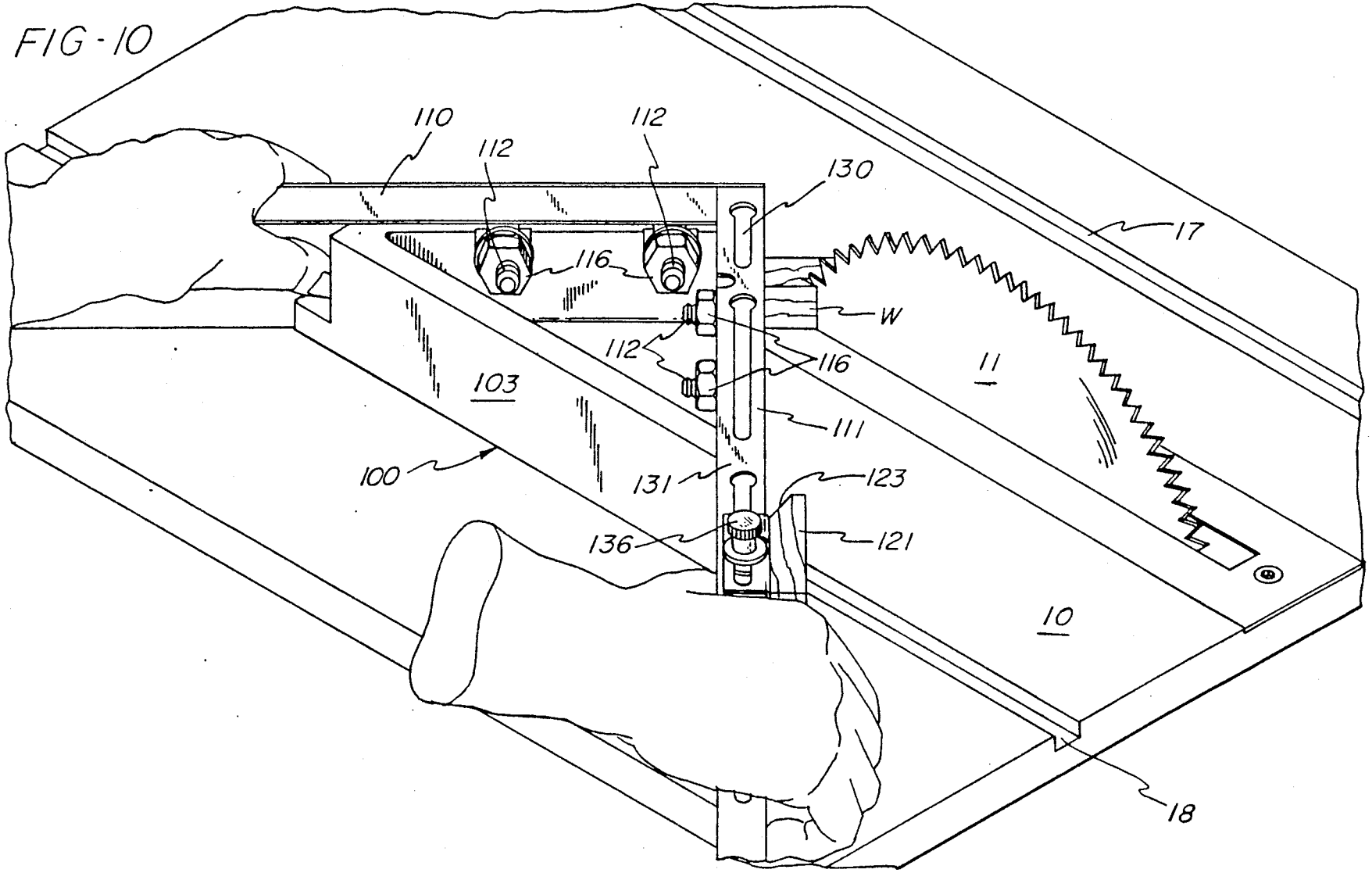
FIG. 10 is a perspective view illustrating the first step of miter cutting one end of the workpiece using the fixture as shown in FIG. 9.

In the use of the fixture 30 for making 45° angle cuts on a series of workpieces, the miter gauge assembly, with the fixture 30 mounted thereon; is set in one of the guide grooves 17 and 18, shown as groove 17 in FIG. 10, and the miter gauge is adjusted to and clamped in the position wherein its face 22 is substantially at right angles to the length of the bar 16 and therefore to the saw blade 11. The working face 34 on fixture 30 will therefore define with the saw blade 11 an angle of substantially 45°.

With the parts in these positions, one end of each of a series of four workpieces to be made into a rectangular frame is miter cut in the usual way, by holding each piece against the face 34 while the miter gauge is used to push the piece past the saw. As illustrated, the cut end of each piece will be the end which will be on the right side of the mitered joint as viewed from the inside of the completed frame. FIG. 6 also illustrated the use of a stop rod assembly 60 to position successive workpiece so that they are cut to exactly the same length. This assembly 60 includes a rod 61 having one end received in the bore 62 in the wall 44 and secured therein by a set screw in the associated tapped bore 63 in the top of wall 44.

The miter gauge 15 is then shifted to the other side of the saw blade with the bar16 fitted in the groove 18, as shown in FIG. 7, and if the stop assembly 60 is being used, its rod 61 is shifted to and secured in the bore 62 in wall 43. This will establish the working face 35 in the position wherein it defines an angle of substantially 45° with the saw blade 11, but the important fact is that so long as the adjustment of the miter gauge body 20 on the bar 16 was not changed, then if there was any deviation from a precise 90° setting of the miter gauge and/or a precise vertical relation between the saw blade and the surface of the worktable, any such deviation which was imparted to the first cut ends will be reproduced in the opposite direction on the workpiece ends which are cut by passing on the other side of the saw blade. Therefore, when the four workpieces are assembled with each first cut end engaging the second cut end of the adjacent piece, the result will be four accurately right angled corners and therefore an accurately square or otherwise rectangular product.

The overall configuration of the body 40 of the fixture 30 contributes to the ease with which it is used and the accuracy of the results achieved thereby. More specifically, with the body 40 open throughout its interior except for the horizontal web 41, which is preferably located with its upper surface in approximately the vertical middle of body 40, the generally triangular recess 65 above web 41 is shaped and proportioned to receive the thump on one hand of the operator, as shown in FIG. 6, while the fingers on the same hand hold a workpiece against one of the working faces 34 and 35. The saw guard is omitted from this view, and the normal penetration of the workpiece by the saw blade is exaggerated, so that the relationships of the components can be visualized, but in practice, the fingers of the user would be protected by a saw guard, and the blade would project no more than ¼ inch above the workpiece.

In other words, it is a simple and convenient procedure for the operator to use one hand to clamp each workpiece to the desired working face on fixture 30 while the other hand pushes the miter gauge assembly past the saw blade. Alternatively, each workpiece can be mechanically secured to the fixture 30 by a C-clamp set with one of its jaws in the recess 65. In either case, it is desirable to provide each of the working faces 34 and 35 with a rough coating, as shown at 66 in FIG. 5, such as a layer of abrasive particles on a cloth or paper backing, to reduce the possibility of having a workpiece slip along the working face during miter cutting.

As noted above, a saw assembly will always include upper and lower saw guards, and the truncated ends of the wall 43 accommodate a saw guard during the cutting operation. Thus referring to FIG. 7, the saw guard 70 is illustrated as of the construction shown in Bartlett U.S. Pat. No. 4,721,023 and is mounted for upward swinging movement when a workpiece is advanced against the beveled or rounded lower edges 71 of its upstream end.

This upward movement of the saw guard should be only just enough to enable the workpiece to travel under it for cutting purposes, so that the workpiece itself shields the edge of the saw blade from ready access by the fingers of the operator. If, however, the fixture 30 is of uniform height out to its triangular ends, then for any workpiece of lesser height, it would be the fixture rather than the workpiece which raised the saw guard, and this would expose a dangerous portion of the saw blade edge between the top of the workpiece and the top of the fixture 30.

Truncating the ends of the body 40 to provide the low shoulders 50 solves two problems. In the first place, each shoulder 50 forms a continuation of the associated working face 34 or 35 and supports each workpiece in close proximity with the saw blade. This is especially important in the cutting of thin materials, such particularly as slim moldings which are otherwise sometimes difficult to saw cleanly without splintering.

The second advantage of the shoulders 50 is that if the workpiece is less thick than the vertical dimension of these shoulders, the shoulder adjacent the blade will be the element which raises the saw guard, and with each shoulder as low as described, exposure of the saw blade will be limited to whatever the difference is between the thickness of the workpiece and the one-half inch height of each shoulder 50, which is obviously would be so small a space above the workpiece as to offer no hazard. For all workpieces greater than one-half inch in thickness, it will be each workpiece itself which raises the saw guard while being supported close to the saw blade by one of the shoulders 50.

If the fixture is used with relatively long pieces, the effective length of the faces 34 and 35 can be increased by securing an extension, such as a straight, parallel faced board, thereto so that it extends laterally therefrom, by means of clamp bolts lying in the pair of slots 75 in the top of each of the walls 44 and 45. If such an extension is used, it would have to be shifted to the other face of fixture 30 when the miter gauge assembly is shifted from one side of the saw blade to the other, but this will in no way affect the accuracy of the results obtained as described above.

Referring now to FIGS. 8–13, the fixture 100 is substantially identical with the fixture 30 except that a slide bar 101 is fixedly secured to its underside by a pair of flat head machine screws 102. The locations of these screws 102 and the threaded holes in bar 101 in which they are received are controlled to align the bar 101 in accurately parallel relation with the hypotenuse face 103 and at accurately defined angles of 45° with the working faces 104 and 105 of fixture 100. Otherwise the fixture 100 may be identical with fixture 30, although because the fixture 100 is designed to be used independently of the miter gauge 15, the studs 52 and bores 53 may be omitted from the hypotenuse face 106.

The bar 101 is dimensioned to fit with a bare sliding clearance in either of the grooves 17 and 18 in the worktable 10, but it should be sufficiently less in thickness than the depth of each groove so that it will not bottom in the groove when the fixture 100 slides along the worktable. For example, the bar 101 may be 0.725 inch by 0.3125 inch in section and 6 inches long.

Figure 8:
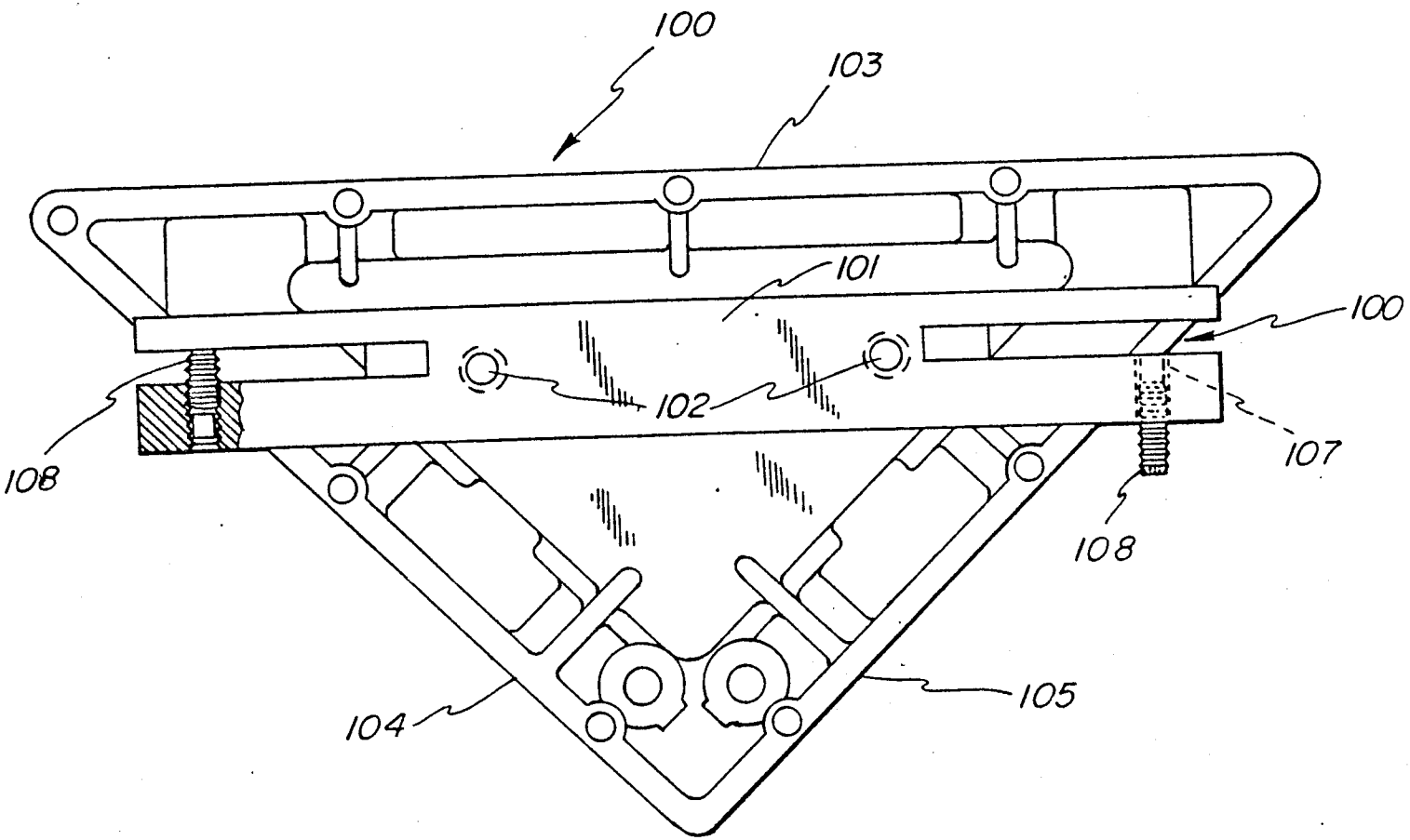
FIG. 8 is a view of the underside of the fixture of the invention equipped for use independently of a miter gauge.

Preferably the bar 101 should include provision for adjusting its width to assure a minimum sliding fit in either groove in order to maintain the desired constant angular relation of the working faces of fixture 100 with respect to the saw blade. For example, as shown in FIG. 8, the bar 101 may have slots 107 in its opposite ends, and have one side of each slot provided with a threaded bore 108 for receiving a set screw 109 which can be adjusted to spread the two sides of the slot as required to achieve the desired sliding clearance of the bar in either of the grooves 17 and 18.

The fixture 100 is provided with a pair of extensions 110 and 111 which are mounted thereon in overhanging relation with its top and working faces. Each of these extensions 110 and 111 is an angled bar of aluminum or other suitable material, and each bar is mounted on the fixture 110 by a pair of flathead machine screws 112 having their heads in countersunk holes 113 in the vertical side of each extension. The bolts 112 lie in grooves 115 in the top walls of the fixture 100 and receive lock washers and flat washers as needed, clamping nuts 116 on their inner ends. The holes 113 in these extensions which receive the bolts 112 are so located that the bolts 112 support the extensions with their lower edges no lower than the bottom of the fixture 100, and they are provided at each end of each extension so that each extension can be mounted on either of faces 104 and 105.

It has been found convenient to make the extension 110 relatively short, e.g. approximately twice as long as the working face 104 on fixture 100 when that face is approximately 5 inches long. The extension 111, however, is preferably substantially longer, e.g. at least about 2 feet in length, for reasons explained hereinafter. Also, the exposed vertical face of each of the extensions 110 and 111 is preferably provided with an abrasive cloth covering 117 as described above in connection with abrasive coverings 66 on the working faces of the fixture 30.

In use, the fixture 100 is mounted on the worktable 10 by fitting the slide bar 101 in one of the guide track grooves 17 and 18 in the upper surface of the worktable 10 with the apex of the fixture closest to the saw blade and with the long extension 111 facing the saw blade. One end of each of the series of workpieces is then miter cut by holding the piece against the short extension 110 and advancing the fixture 100 along the track groove past the saw blade. This operation is illustrated in FIG. 10, with the saw guide removed for clarity of illustration.

The final cut on each workpiece is then made while holding the piece against the long extension 111 as shown in FIG. 11, again with the saw guard removed for clarity of illustration. Preferably, cutting of each workpiece to a predetermined length is assured by means of an adjustable stop assembly 120 mounted on the long extension 111, the details of which are shown in FIGS. 12-13.

More specifically, the stop assembly 120 comprises a block 121 of a suitable hardwood, such as poplar, birch or maple, having one end 123 beveled at 45° to its length and mounted on the extension 111 by an angle bracket 125 to which the block 121 is secured by a pair of flathead screws 126 with its beveled end 123 facing inwardly. Provision is made for adjusting the stop assembly 120 to any desired position lengthwise of the extension 111.

Figure 9:
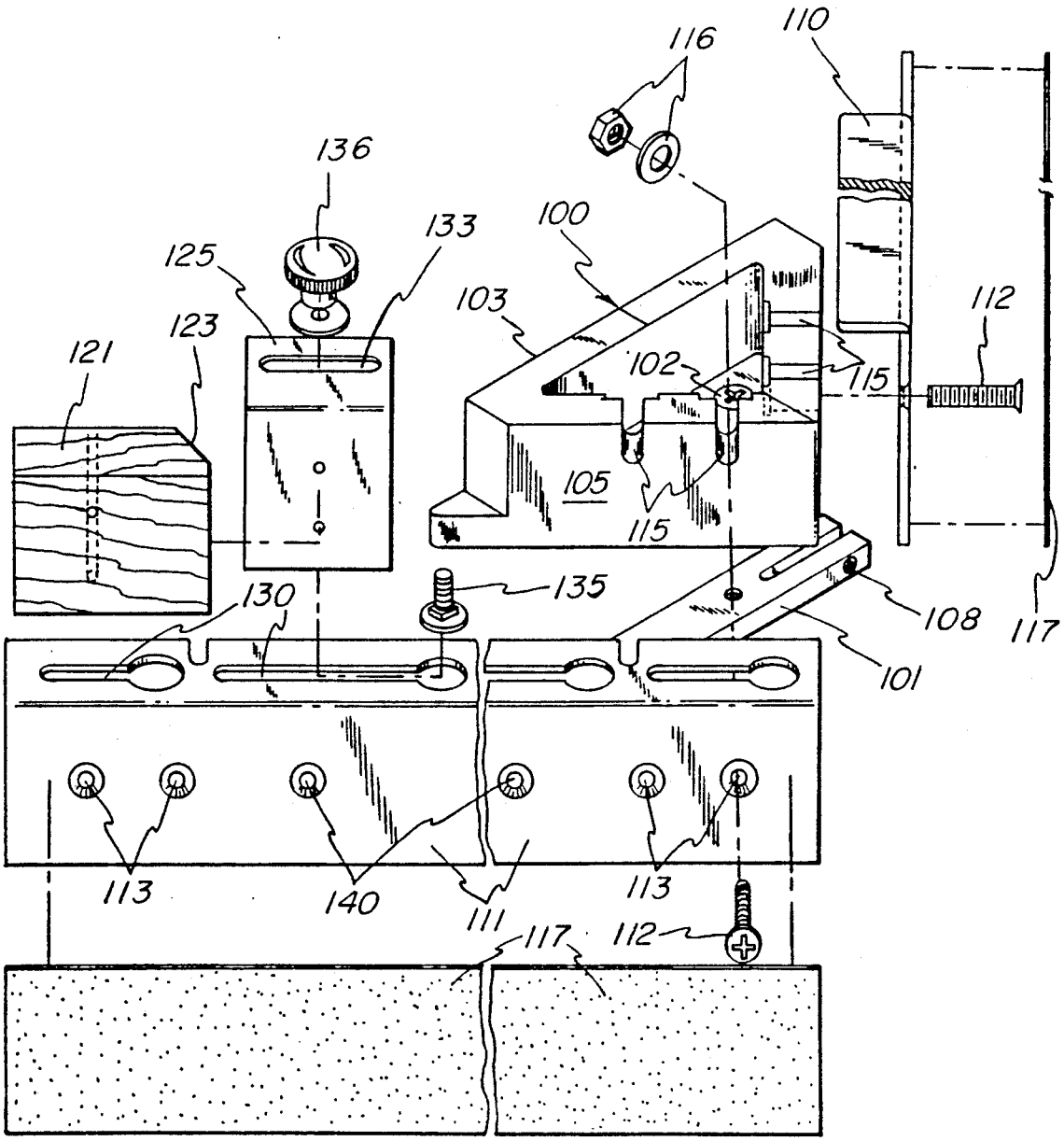
FIG. 9 is an exploded perspective view of the fixture as shown in FIG. 8 together with respectively short and long extensions for its working faces, and with the long extension equipped with an adjustable stop for locating a workpiece with respect to the saw blade.
Figure 12:
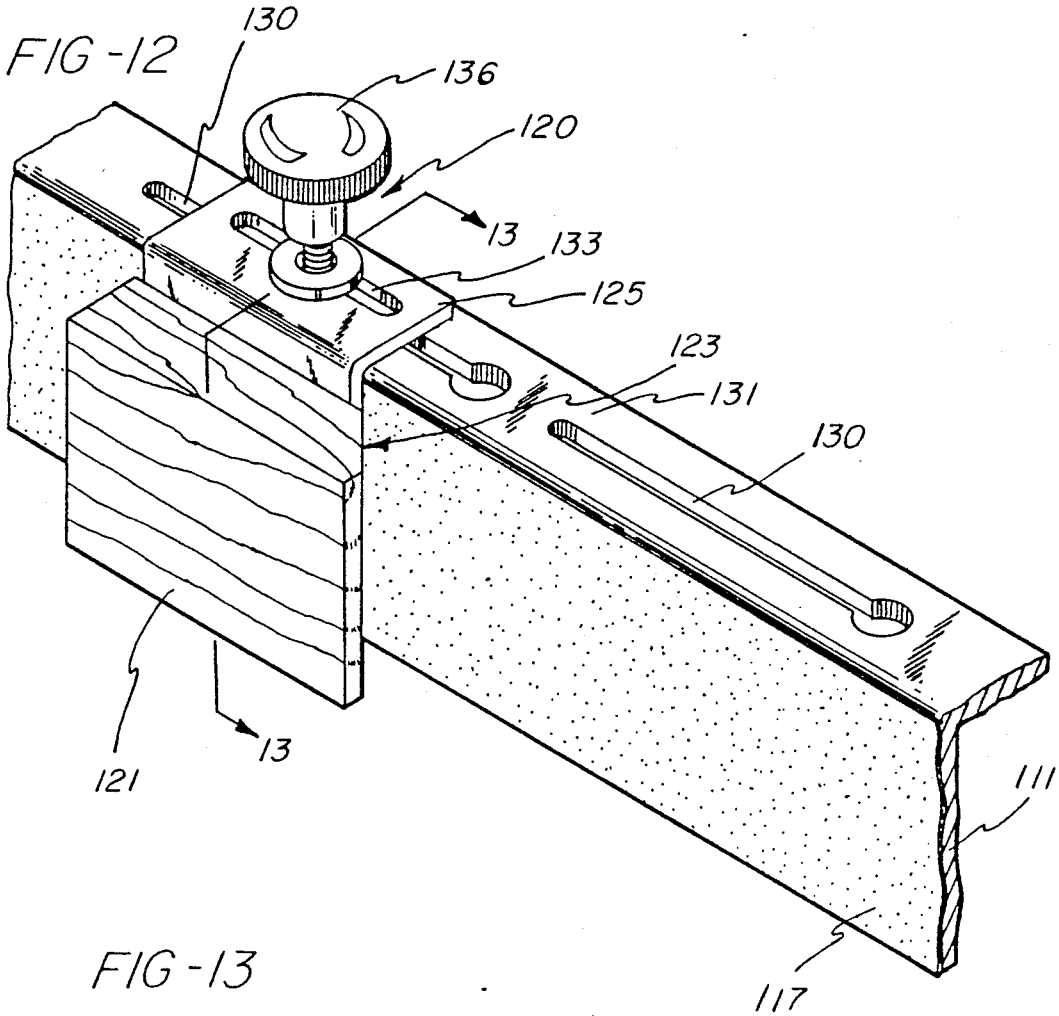
FIG. 12 is a fragmentary perspective view illustrating the stop assembly on the long extension as shown in FIGS. 9-10.
Figure 13:
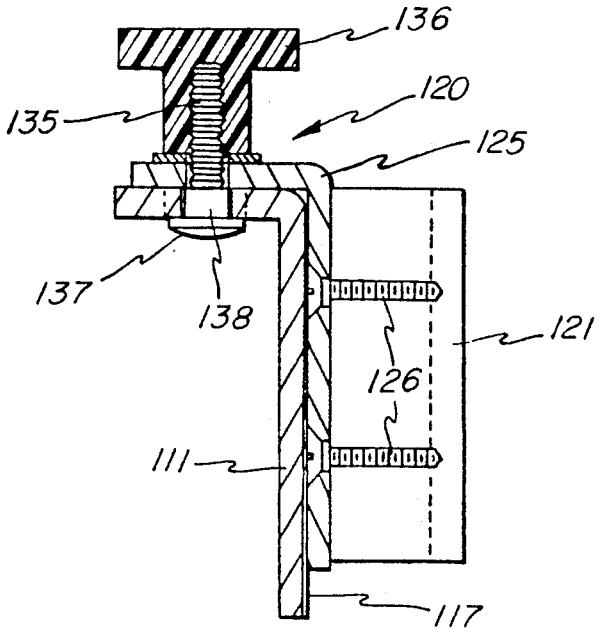
FIG. 13 is a section on the line 13—13 in FIG. 12.

Referring to FIGS. 9 and 12, the upper, horizontal side of the extension 111 is provided with a series of elongated keyhole slots 130 separated by short lands 131. The bracket 125 has a slot 133 in its upper horizontal leg, and a bolt 135 extends through this slot from the under side of the bracket and receives a threaded knob 136 on its upwardly projecting threaded end.

The bolt 135 has a head 137 sized to pass through the rounded enlarged end of each key slot 130, and it also has a square shoulder 138 adjacent its head which is sized to fit in the slots 130. With this arrangement, after the bolt 135 is inserted in one of the key slots 130, it can slide the full length of the slot carrying the bracket 125 with it, and when the knob 136 is tightened on the bolt 135, that will clamp the stop assembly 120 to the extension 111.

It will be understood that the proper position of the stop assembly 120 is determined by careful measurement for each cutting operation so that when the previously miter cut end of a workpiece is set against the beveled end 123 of the block 121, the uncut end of the workpiece is in properly aligned relation with the saw blade to be cut off to exactly the proper length. If it should happen that the proper position of the bracket 125 might require that the bolt 135 be located at the enlarged end of the key slot 130, or where there is a land 131, the bolt 135 can be moved in either direction to a position where it is in the narrow portion of a slot 130, and further adjustment of the stop assembly can then be carried out by sliding the bracket on the bolt 135 lengthwise of the slot 133.

If the fixture of the invention is to be used for miter cutting workpieces longer than the long extension 111, a supplemental extension can be attached thereto, such as a board which is secured to the free end of the extension 111 by means of screws and the top slots 130 therein. The primary purpose for such an extra extension is to serve as a support for a stop when cutting a substantial number of workpieces to the same length. Then rather than attempting to utilize the stop assembly 120, a block of wood can be secured to the extension board by screws or a clamp in an accurately spaced position from the saw blade.

The long extension 111 can also be used with the miter gauge 15, to extend its working face 22, and for this purpose it is mounted thereon by moving one of the clamping screws 112 to the extra hole 140 and setting the two screws 112 in the slots 23 in gauge 15.

When the fixture of the invention is utilized as described above, the miter cut joint between any pair of workpieces will consistently reproduce the right angled relation of the working sides 104 and 105 of the fixture 100. It is important, however, that since both ends of each workpiece will be cut on the same side of the saw blade, a blade must be accurately vertical, because when used in this manner, the fixture of the invention will not compensate for vertical misalignment of the saw blade. If a particular saw blade is difficult to maintain in an accurately vertical position, this can be compensated for by utilizing the fixture 100 in a different manner.

Figure 11:
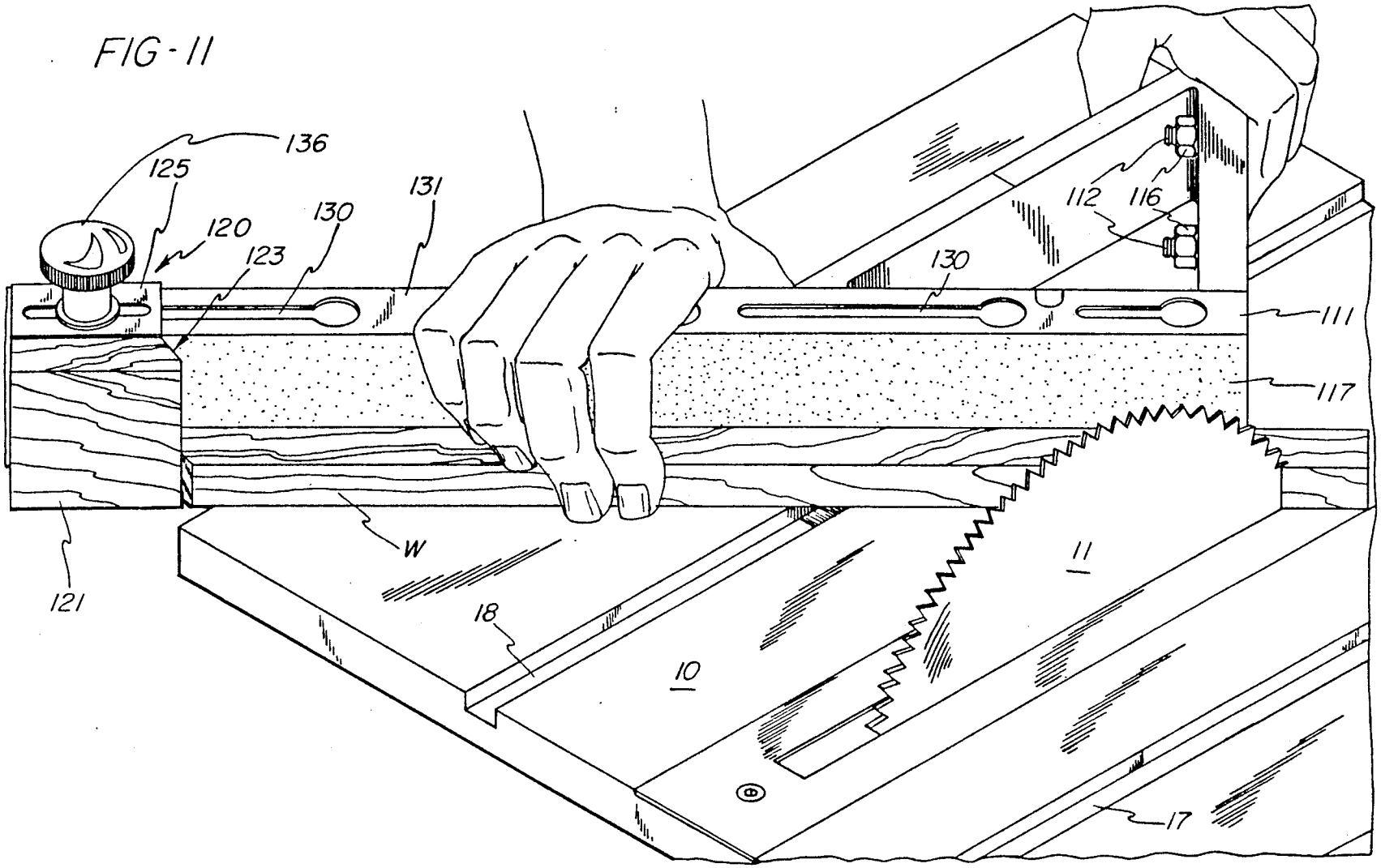
FIG. 11 is a view similar to FIG. 10 illustrating the second step of miter cutting the other end of the workpiece with the stop assembly in place to assure accurate control of the final length.

More specifically, FIGS. 10 and 11 show the fixture 100 as utilizing the groove 18 in the tabletop 10 for both cuts. To compensate for vertical misalignment of the saw blade, the fixture should utilize the groove 17 for the miter cutting of the first end of each workpiece, holding the workpiece against the short extension 110. The fixture should then be transferred to the groove 18 for the cutting of the second end of each workpiece while the workpiece is held against the long extension 111.

While the forms of apparatus herein described constitutes preferred embodiments of the invention, it is to be understood that the invention is not limited to these precise forms of apparatus and that changes may be made therein without departing from the scope of the invention which is defined in the appended claims.

What is claimed is:

1. Apparatus for making miter cuts on the ends of a plurality of workpieces which will provide an accurate 90° mitered corner joint between each pair of such workpieces, comprising:

(a) a worktable having a slot therethrough for receiving a saw blade, (b) a power operated saw blade mounted below said worktable and projecting upwardly through said slot, (c) said worktable having a groove therein on each side of said slot forming a guide track extending parallel with said slot, (d) a miter gauge including a gauge body and a slide bar configured for linear movement along either of said grooves selectively so that said gauge may be guided past either side of said saw blade, (e) said gauge body having a flat vertical face whereon each workpiece is held for guided movement therewith along said worktable past said saw blade, (f) means adjustably mounting said gauge body on said slide bar for establishing a desired angle defined by said vertical face and said saw blade along which a workpiece held against said face is cut by said saw blade and including a centered position of said gauge wherein said face is at right angles to said blade, (g) a fixture having in plan view an isosceles right triangular configuration providing a vertical hypotenuse face and a pair of vertical working faces converging from said hypotenuse face at angles of 45° to said hypotenuse face to define an angle of 90° between said pair of working faces, and (h) means for securing said fixture to said gauge with said hypotenuse face of said fixture in contact with said vertical face of said gauge body, (i) whereby when said gauge is moved along one of said guide tracks in a predetermined angular setting of said adjustable mounting and then along the other said tracks without changing said adjustable mounting, the angles respectively defined by said saw blade and the adjacent said working face on said fixture will total 90°.

2. Apparatus for use in making miter cuts on the ends of a plurality of workpieces on a power tool which includes a worktable having a slot therethrough, a power operated saw blade mounted below said worktable and projecting upwardly through said slot, a groove in said worktable on each side of said slot forming a guide track extending parallel with said slot, a miter gauge including a gauge body and a slide bar configured for linear movement along either of said grooves selectively so that said gauge may be guided past either side of said saw blade, said gauge body having a flat vertical face whereon each workpiece is held for guided movement therewith along said worktable past said saw blade, and means adjustably connecting said gauge body with said slide bar for establishing a desired angle defined by said vertical face and said saw blade along which a workpiece held against said face is cut by said saw blade, said apparatus comprising:

(a) a fixture including a body having in plan view the configuration of an isosceles right triangle providing a vertical hypotenuse face and a pair of vertical side faces converging at angles of 45° from said hypotenuse face, (b) each of said side faces having sufficient height and length to form a working face for supporting a workpiece, and (c) means for securing said body to said miter gauge with said hypotenuse face of said body engaging said vertical face of said gauge body, (d) whereby when said gauge is moved along one of said guide tracks in a predetermined angular setting of said adjustable mounting and then along the other slide tracks without changing said adjustable mounting, the angles respectively defined by said saw blade and the adjacent said working face on said fixture will total 90°.

3. Apparatus as defined in claim 1 or claim 2 wherein said adjustable mounting includes means for establishing said vertical face of said miter gauge body at substantially 90° to said guide tracks, whereby any variation from 45° in one direction (plus or minus) of the angle defined by said saw blade and one of said working faces of said fixture body will be equaled in the opposite direction by the angle defined by said saw blade and the other of said working faces of said fixture body.

4. Apparatus as defined in claim 2 wherein each of said working faces on said fixture body is the outer surface of a wall, and said body includes a recess on the inner surface of each said wall which is open at the top thereof to receive the thumb on one hand of an operator while the fingers on the same hand hold a workpiece on the associated said working face whereby said hand can manually clamp said workpiece to the associated said wall.

5. Apparatus as defined in claim 2 wherein said fixture body is provided with an open-topped central recess which is surrounded by three walls, the outer surfaces of said wall constituting said hypotenuse face and said working faces respectively, and said recess being configured to receive the thumb on one hand of an operator while the fingers on the same hand hold a workpiece on the associated said working face whereby said hand can manually clamp said workpiece to the associated said wall.

6. Apparatus as defined in claim 2 for use with a power tool which includes a saw guard mounted on the downstream side of the saw blade for upward swinging movement upon engagement of a workpiece with the lower edge of said guard to expose the blade as the workpiece is moved therepast, and further characterized in that the upper portion of said body is truncated adjacent both ends of and substantially perpendicularly to said hypotenuse face to provide a shoulder at each end of said hypotenuse face which is of substantially less height than said working face in order to fit under said saw guard as said miter gauge and said fixture are moved past said saw blade, and each said shoulder includes a front face forming an extension of the adjacent said working face for supporting a workpiece in close relation to the saw blade.

7. Apparatus for use in making miter cuts on the ends of a plurality of workpieces on a power tool which includes a worktable having a slot therethrough, a power operated saw blade mounted below said worktable and projecting upwardly through said slot, and a groove in said worktable on one side of said slot forming a guide track extending parallel with said slot, said apparatus comprising:

(a) a fixture including a body having a plan view the configuration of an isosceles right triangle providing a vertical hypotenuse face and a pair of vertical side faces converging at angles of 45° from said hypotenuse face, (b) each of said side faces having sufficient height and length to form a working face for supporting a workpiece, (c) a slide bar configured for linear guided movement along said grooved track, (d) means securing said slide bar to the underside of said body with said bar defining an angle of 45° with each of said working faces, whereby when said fixture is moved along said track, the angles respectively defined by said saw blade and each of said working faces on said fixture will total 90°, (e) an extension member of substantially the same height as one of said working faces but of substantially greater length than said working face, (f) selectively useable means for securing said extension member to one or the other of said working faces to form an extension thereof for supporting a workpiece.

(g) said extension member being right-angled in vertical section and having one side thereof overlying the associated said working face of said fixture and the other side thereof overlying a portion of said fixture and extending thereof away from said slot, (h) means defining a stop for establishing one end of a workpiece in predetermined spaced relation with said saw blade, and (i) means forming an adjustable mounting of said stop means on said horizontal side of said extension member providing for adjustment of the position of said stop means lengthwise of said extension member.

8. Apparatus as defined in claim 7 wherein said adjustable mounting for said stop means comprises a right-angled bracket configured to fit over said two sides of said extension member, means defining a series of spaced keyhole slots in said horizontal side of said extension member, and clamping means carried by said bracket and configured for cooperation with said keyhole slots to secure said bracket in adjusted position lengthwise of said extension member.

9. Apparatus as defined in claim 8 further comprising adjustable means securing said stop means to said bracket for adjustment on said bracket lengthwise of said extension member.

* * * * *